US006486842B2

(12) United States Patent
Wang

(10) Patent No.: US 6,486,842 B2
(45) Date of Patent: Nov. 26, 2002

(54) PIVOTTABLE CONNECTION CONFIGURATION OF RETRACTABLE ROOF MOUNTED ANTENNA

(75) Inventor: Jinsong Wang, Kawasaki (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 09/875,126

(22) Filed: Jun. 6, 2001

(65) Prior Publication Data

US 2001/0050649 A1 Dec. 13, 2001

(30) Foreign Application Priority Data

Jun. 6, 2000 (JP) ..... 2000-169227

(51) Int. Cl.[7] ..... H01Q 1/12
(52) U.S. Cl. ..... 343/715; 343/882; 343/888
(58) Field of Search ..... 343/711, 712, 343/713, 715, 878, 882, 906, 888

(56) References Cited

U.S. PATENT DOCUMENTS

| | | | | | |
|---|---|---|---|---|---|
| 2,313,652 | A | | 3/1943 | Lyman | 343/903 |
| 4,115,779 | A | | 9/1978 | Dantzler et al. | 343/715 |
| 5,032,846 | A | * | 7/1991 | Chang | 343/882 |
| 5,402,135 | A | * | 3/1995 | DeMarre et al. | 343/715 |
| 5,515,064 | A | * | 5/1996 | Bacnik et al. | 343/860 |
| 5,565,877 | A | * | 10/1996 | Du et al. | 343/715 |
| 5,661,497 | A | * | 8/1997 | Calearo | 343/715 |
| 6,062,912 | A | | 5/2000 | Witczak et al. | 439/680 |

FOREIGN PATENT DOCUMENTS

| | | |
|---|---|---|
| DE | 10 16 329 B | 9/1957 |
| EP | 1 182 726 A2 | 2/2002 |

* cited by examiner

*Primary Examiner*—Tan Ho
(74) *Attorney, Agent, or Firm*—Pennie & Edmonds LLP

(57) ABSTRACT

A joint assembly provided to an end portion of antenna rod is placed between supporting portions of an antenna base. A click cylinder is then introduced into a hole of the supporting portion to engage recess and convex portions formed on a plate as an end surface of the click cylinder and an inner sursurface of the joint assembly, thereby generate click resistance. A coil spring is inserted into the click cylinder thereafter, then a bolt is introduced into the click cylinder through a washer. The bolt is screwed with a nut via a wave washer, a washer, and a spring washer.

4 Claims, 4 Drawing Sheets

PIVOTTABLE CONNECTION CONFIGURATION OF RETRACTABLE ROOF MOUNTED ANTENNA

CROSS-REFERENCE TO RELATED APPLICATIONS

This application is based upon and claims the benefit of priority from the prior Japanese Patent Application No. 2000-169227, filed Jun. 6, 2000, the entire contents of which are incorporated herein by reference.

BACKGROUND OF THE INVENTION

1. Field of the Invention

The present invention relates to a pivottable connection configuration of a retractable roof mounted antenna, especially for an automobile.

2. Description of the Related Art

FIG. 1 illustrates a conventional retractable automobile roof mounted antenna 10. FIG. 1 shows an antenna rod 11, an antenna base 12, a coaxial cable 13 extending from the bottom face of the antenna base, and a connecting plug 14 provided to the end portion of the coaxial cable 13 so as to connect the antenna with a tuner of the automobile on which the antenna is mounted.

As shown in FIG. 1, the antenna rod 11 has a retractable configuration that can be fixed at three positions, i.e., at 0°, 60°, and 180° to the antenna base 12. The antenna rod 11 is configured such that a user can feel proper click resistance so as to firmly fix the antenna rod at respective positions.

FIG. 2 illustrates the specific structure for giving the click resistance to the roof mounted antenna shown in FIG. 1, especially to the pivottable connection member thereof.

The antenna rod 11 shown in FIG. 2 is provided at the proximal end portion with a cylindrical joint assembly 21 the axis direction of which is orthogonal to the axis direction of the antenna rod 11. The joint assembly 21 of the antenna rod 11 is engaged to the upper portion of the antenna base 12 so as to fix it to the antenna base by integrally fastening them with a bolt 22 or the like.

More specifically, one end portion (the left side portion shown in the illustration) of the joint assembly 21 has a terminal formed of a metal plate as a cover thereof. The terminal moves and contacts a terminal member 12*b* (described later) provided to the antenna base 12 so as to be electrically connected to the terminal member 12*b*. A coil spring 23 is to be introduced into an opening on the side of the other one end portion of the joint assembly 21 through a washer 24 in order to hold a click case assembly 25 in the joint assembly 21.

The upper portion of the antenna base 12 has a pair of banks so as to place the antenna base 12 therebetween. One of the banks (the right side portion shown in the illustration) has a hexagonal hole 12*a* in the wall thereof. Another one of the banks (the left side portion shown in the illustration) is formed as a terminal 12*b* having a hole formed in a size such that the bolt 22 can pass through it.

The joint assembly 21 is placed between the pair of the banks such that an O-ring 26 is held between the terminal 12*b* and the joint assembly 21. In this condition, the click case assembly 25 holding the spring 23 and the washer 24 therein is put into the joint assembly 21 from the outside of the hexagonal hole 12*a*. A bolt 22 having a hexagonal click plate 27 to penetrate it is introduced into the hexagonal hole 12*a* of the antenna base 12 from the outside to pass through the pair of the banks. The end tip of the bolt 22 projecting from the wall of the bank as the terminal 12*b* of the antenna base 12 is fastened with a nut 30 via a washer 28 and a spring washer 29 to fix it. By fabricating the components in this manner, the antenna rod 11 and the antenna base 12 can be integrally assembled.

The click case assembly 25 has recesses and convexes on the outer surface to be engaged with the recesses and convexes formed on the inner wall of the joint assembly 21. With this structure, the click case assembly is prevented from rotating in the circumferential direction.

In the same manner, the click plate 27 is also prevented by its own hexagonal shape from rotating in the circumferential direction, although it moves in the hexagonal hole 12*a* in the axis.

As shown in FIG. 3, the click case assembly 25 has a hole 251 formed by pressing in the central portion of the outer face of the bottom on which the click case assembly 25 contacts the click plate 27, such that the bolt 22 passes through it. A plate 25 having a pair of hemispherical convex portions 252 and 252 spaced apart by 180° and opposing across the hole 251 is put into the bottom of the click assembly 25.

On the other hand, the click plate 27 contacting the plate 25*a* of the click case assembly 25, more precisely, comprises the hexagonal plate and a disk the circumference to inscribe the hexagonal circumference of the plate, which are integrally formed. To illustrate the more specific structure of the disk, the disk face contacting the click assembly 25 is shown in FIG. 3. As shown in the drawing, the disk is made of a cut thick aluminum plate, i.e., so-called cutout. The disk has a hole 271 in the central portion so as to introduce the bolt 22, and two pairs of grooves 272 and 272, 273 and 273, respectively spaced apart by 180° and opposing across the hole 271. The grooves 272 and 272 and the grooves 273 and 273 are shifted from each other by 60° as a central angle on the hole 271 as a center.

With the above-mentioned structure, in contacting the plate 25*a* of the click case assembly 25 with the click plate 27, the convex portions 252 and 252 of the click case assembly 25 shift to either of the grooves 272 and 272 and the grooves 273 and 273 due to the rotation of the antenna rod 11. In this manner, the convex portions 252 and 252 of the click case assembly 25 are engaged with either of the grooves 272 and 272 and the grooves 273 and 273, to generate the click resistance.

By virtue of this structure, the contacting force between the plate 25*a* of the click case assembly 25 and the click plate 27, and the contacting force between the terminal 12*b* of the antenna base 12 and the joint assembly holding the O-ring 26 therebetween are adjusted by the elasticity of the coil spring 23 in accordance with the fastening force of the nut 30 fastening the bolt 22. The click torque and the electric connection between the terminals thus depend on the adjustment of the contacting forces.

With the above-mentioned pivottable connection configuration of the retractable roof mounted antenna 10, the click torque according to the elasticity of the coil spring 23 and the fastening force of the nut 30 is generated by engaging the convex portions 252 and 252 formed in the plate 25*a* of the click case assembly 25 and the grooves 272 and 272 and the grooves 273 and 273 in the click plate 27 fixed to the hexagonal hole 12*a* of the antenna base 12.

FIG. 4 shows the rear side of the joint assembly 21, which is not shown in FIG. 2. A terminal face 21*a* on which the joint assembly 21 contacts the terminal 12*b* has a plurality of, e.g., three hemispherical convex portions 211, 211, and 211 formed to strengthen the electric connection. The click torque is also generated between the hemispherical convex portions 211, 211, and 211 and the terminal 12*b* of the antenna base 12. The hemispherical convex portions 211, 211, and 211 frictionally contact and slides on the terminal 12*b* to connect with the terminal 12*b*. By this connection, the antenna signal obtained by the antenna rod 11 is transmitted to the coaxial cable 13 via the antenna base 12.

With this structure, however, the portion for generating the click torque and the portion for transmitting the antenna signal need to be formed in different manufacturing processes. Especially, the click plate 27 is formed by cutting, which increases the manufacturing cost thereof, and the manufacturing cost of the antenna will be increased.

Further, the terminal face 21*a* of the joint assembly 21 is pressed by the terminal 21*b* of the antenna base 21 by the elasticity of the coil spring 23, thereby frictionally slides on the terminal 21*b* of the antenna base 21 by the elasticity of the coil spring 23, and transmits the antenna signal. With this structure, the hemispherical convex portions 211, 211, and 211 formed in the terminal face 21*a* of the joint assembly 21 is pressed with strong force of the coil spring 23 on the terminal 12*b*.

The hemispherical convex portions 211, 211, and 211 thus will be easily worn by the clicks, and the lifetime of the hemispherical convex portions will be shortened extremely if the mounting angle of the antenna rod 11 is changed so frequently.

In addition to the problems mentioned above, the assembling process of the antenna is so complicated as shown in FIG. 2. In the assembling process, the click case assembly 25 into which the coil spring 23 is inserted needs to be introduced into the hexagonal hole 12*a* from the outside such that the convexes and recesses formed on the outer circumferential surface of the click case assembly 25 are engaged with the recesses and convexes formed on the inner circumferential surface of the joint assembly 21, and then the bolt 22 is inserted. Then, the bolt 22 penetrating the hexagonal click plate 27 is inserted such that the hexagonal click plate 27 is properly put into the hexagonal hole 12*a* till the end tip of the bolt 22 projects from the outer wall of the terminal 12*b*. Consequently, the structure mentioned above lowers the assembling efficiency so much.

BRIEF SUMMARY OF THE INVENTION

The present invention is carried out to solve the above-mentioned problems, and an object of the present invention is to provide a pivottable connection configuration of a retractable roof mounted antenna by suppressing the increase of the manufacturing cost of the components, improving the assembling efficiency, and lengthening the lifetime of the antenna.

The pivottable connection configuration of a retractable roof mounted antenna, which has an antenna rod and an antenna base for rotatably supporting the antenna rod, according to the present invention is characterized by comprising: a joint portion provided to one end portion of the antenna rod, the joint portion having a cylindrical member with a bottom and a rotation axis orthogonal to an axis of the antenna rod, the cylindrical member having a first and second surfaces perpendicular to the rotation axis, the first surface having one of recess and convex portions for generating click resistance, the second surface having a terminal surface electrically connected to the antenna rod; a pair of supporting portions comprising a first and second supporting portions formed in an upper portion of the antenna base so as to surface each other, the first supporting portion having a through hole, the second supporting portion having a terminal portion electrically connected to the terminal surface of the joint portion on an inner surface facing to the through hole; and a click cylinder having one of convex and recess portions to be engaged with the one of the recess and convex portions of the first surface of the cylindrical member.

It is preferable to further comprise a coil spring to be introduced into the click cylinder and a washer introduced into the through hole, and is preferable that the washer is engaged with the first supporting portion such that rotation on an a supporting axis of the first and second supporting portions is controlled.

It is preferable to further comprise a wave washer contacting an outer surface of the second supporting portion; a bolt passing through the members and the portions comprising the pivottable connection configuration; and a nut for screwing the bolt.

With this structure, click torque is generated between the inner surface of the bottom face of the joint assembly and the outer face of the bottom face of the click cylinder by virtue of the elasticity of the coil spring. In the same time, the outer face of the bottom of the joint assembly is frictionally contacted with the terminal portion on an inner face of another one of the supporting portion by virtue of the elasticity of the wave washer, and the electric connection for transmitting the antenna signal can be obtained thereby. With this structure, the portion for generating the click resistance and the portion for transmitting the antenna signal can be formed as an integral component, and thus all the metal components necessary for the structure of the present invention can be manufactured in a presswork or the like. With the result, the manufacturing cost of the components can be reduced so much.

Further, this structure need no conventional complicated assembling such that the coil spring must be pressingly held and the components are positioned to be penetrated by the bolt and then the bolt must be screwed with the nut. Accordingly, the assembling process can be considerably simplified in comparing with the structure of the conventional pivottable connection configuration, and thus the assembling efficiency can be remarkably improved.

In addition, since a member with low elasticity can be employed as the wave washer, the terminals can be electrically connected without so large click torque. Accordingly, the recess and convex portions for generating the click resistance can be prevented from being worn by large click torque, and thus the lifetime of the antenna can be lengthened even if the antenna rod is rotated so frequently.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention can be more fully understood from the following detailed description of an embodiment of the invention in conjunction with the accompanying drawings.

Figure 1:
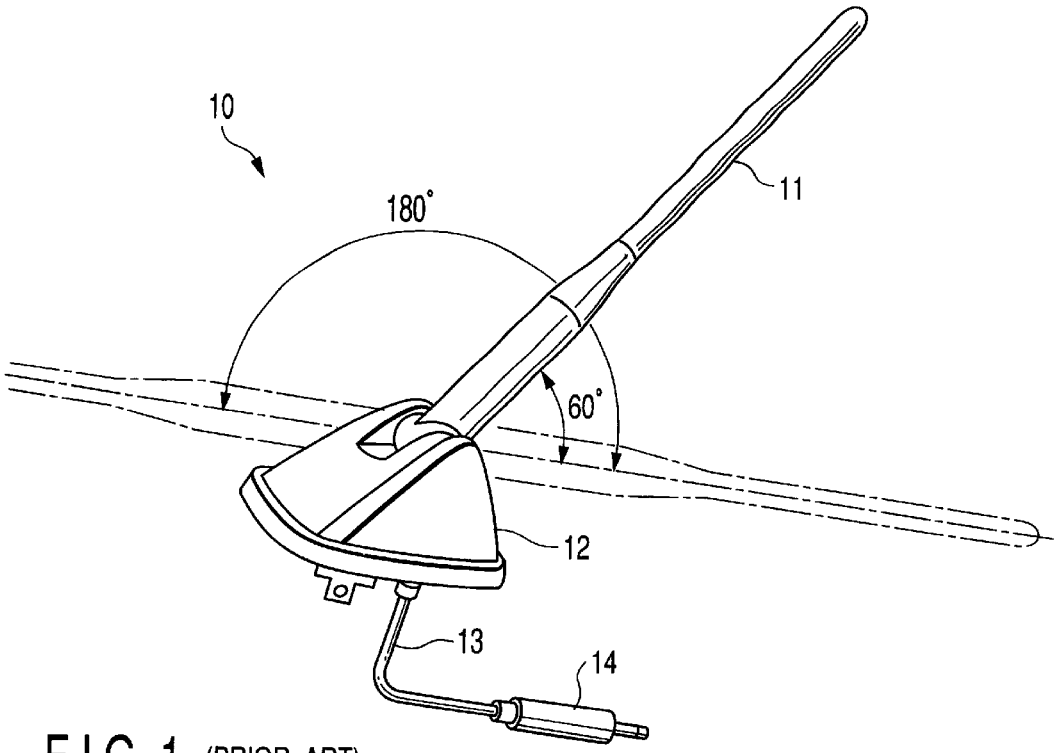
FIG. 1 (PRIOR ART)
FIG. 1 is a perspective view showing the general retractable roof mounted antenna.
Figure 2:
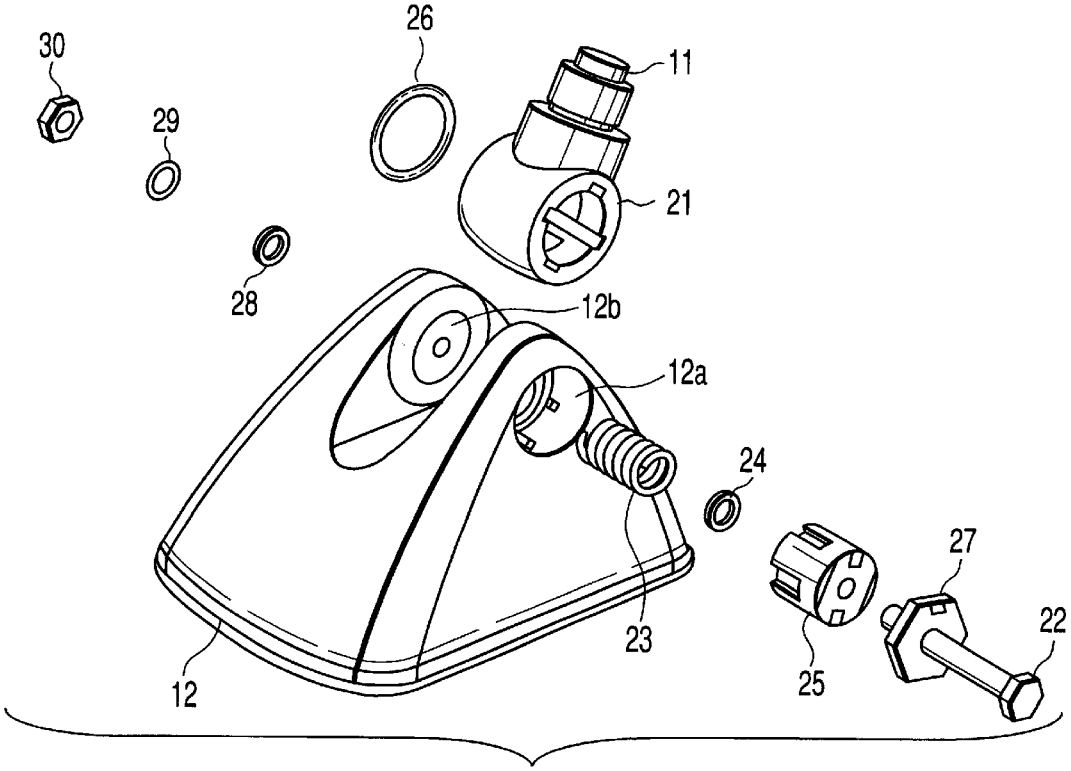
FIG. 2 (PRIOR ART)
FIG. 2 is a perspective view showing the specific structure of the pivottable connection configuration of the conventional retractable roof mounted antenna.
Figure 3:
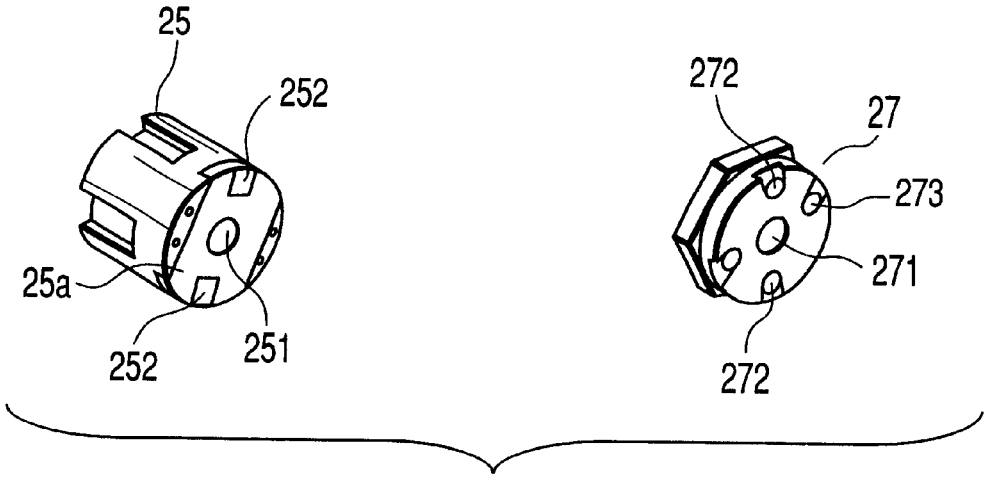
FIG. 3 (PRIOR ART)
FIG. 3 is a perspective view showing the specific structure of the click case assembly and the click plate shown in FIG. 2.
Figure 4:
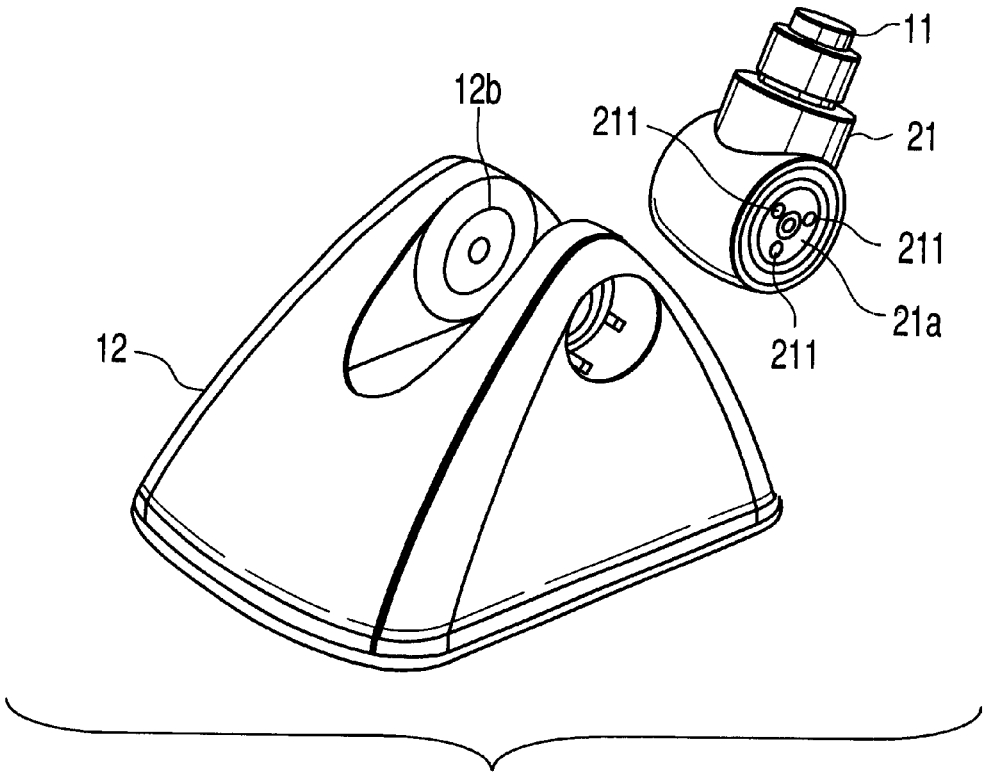
FIG. 4 (PRIOR ART)
FIG. 4 is a perspective view showing the specific structure of the rear side of the joint assembly and the specific structure of the antenna base shown in FIG. 2.
Figure 5:
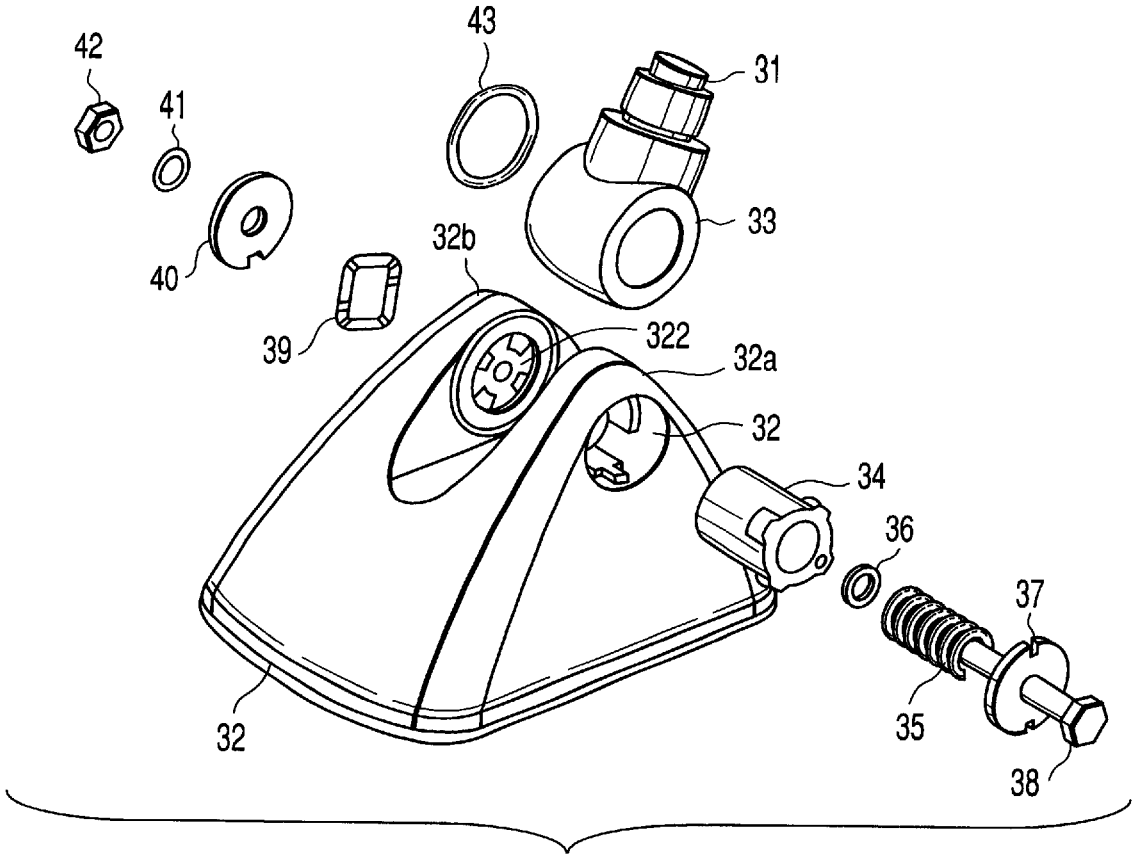
FIG. 5 is a perspective view showing the specific structure of the pivottable connection configuration of the retractable roof mounted antenna according to the present invention.

FIG. 5 specifically illustrates the structure for generating click resistance in the pivottable connection configuration. FIG. 5 shows an antenna base 32 for supporting an antenna rod 31 and a joint assembly 33 provided to the proximal end portion of the antenna rod 31 to be rotatably supported by the antenna base 32.

Figure 6:
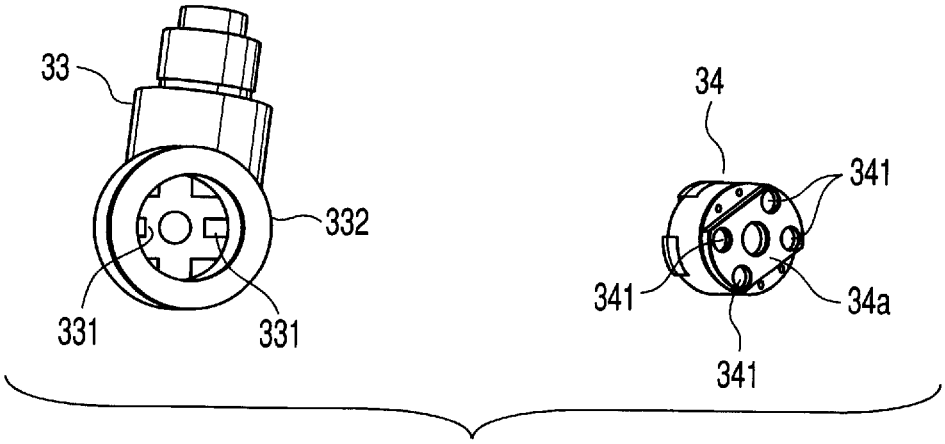
FIG. 6 is a perspective view showing the specific structure of the joint assembly and the click cylinder shown in FIG. 5.

The joint assembly 33 comprises a cylindrical member 332 with a bottom. The member 33 has a rotation axis parallel to an axis orthogonal to the axis of the antenna rod 31. As shown in FIG. 6, two hemispherical convex portions 331 and 331 for generating the click resistance are spaced apart by 180° on the inner face of the bottom of the cylindrical member 332 and opposing across the center of the bottom.

Figure 7:
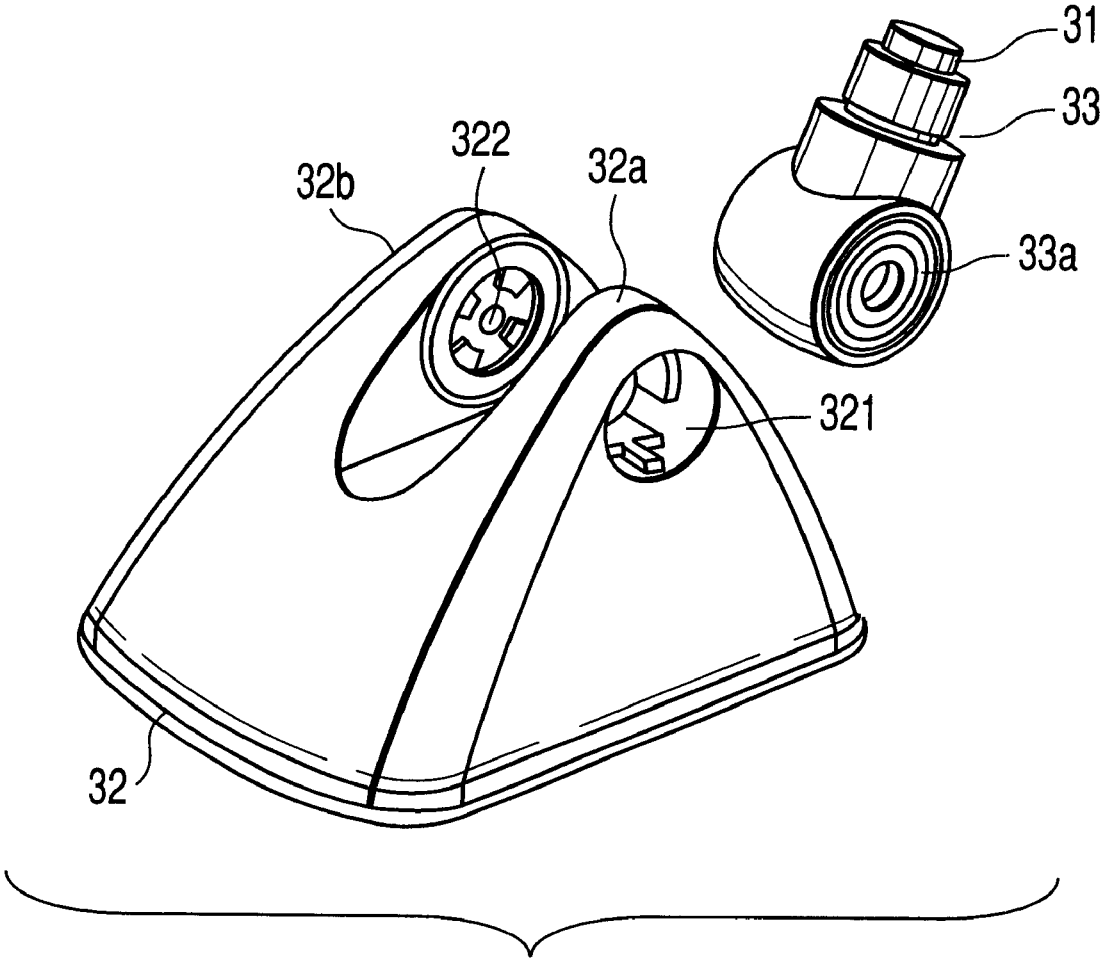
FIG. 7 is a perspective view showing the specific structure of the rear side of the joint assembly and the specific structure of the antenna base shown in FIG. 5.

As shown in FIG. 7, the outer face of the cylindrical member 332 is formed as a terminal portion 33*a* for transmitting the antenna signal received by the antenna rod 31.

The antenna base 32 is provided at the upper portion with a pair of supporting portions 32*a* and 32*b* for rotatably supporting the joint assembly 33 such that the supporting portions face each other. The supporting portion 32*a* has a hole 321 having an axis which faces the supporting portions. The inner face of the supporting portion 32*b*, which faces the hole 321, has a terminal 322 contacting the terminal portion 33*a* of the joint assembly 33 to be electrically connected thereto.

In the condition where the joint assembly 33 is placed between the supporting portions 32*a* and 32*b* such that an O-ring 43 is inserted between the terminal portion 33*a* of the joint assembly 33 and the terminal portion 322 of the supporting portion 32*b*, a click cylinder 34 is introduced into the hole 321 of the supporting portion 32*a*.

The click cylinder 34 has a bottom plate 34*a* formed by pressing or the like to inlay in the outer face of the bottom, in which a plurality of pairs of holes 341 and 341, . . . are formed corresponding to a plurality of click positions to be engaged with the convex portions 331 and 331. The click cylinder 34 also has recess and convex portions alternately near the outer circumferential end portion on the side of opening opposite to the bottom plate 34*a*, which are provided to be engaged with the inner circumferential face so as to prevent the rotation in the hole 321 of the supporting portion 32*a* on the plane orthogonal to the axis of the click cylinder 34.

A coil spring 35 is then introduced into the opening of the click cylinder 34 through a washer 36. After the introduction of a washer 37 for preventing the rotation in the hole 321 of the supporting portion 32*a* on the plane orthogonal to the axis of the click cylinder 34, a bolt 38 penetrates the introduced components, i.e., the washer 37, the coil spring 35, the washer 36, the bottom plate 34*a* of the click cylinder 34, and the terminal portion of the supporting portion 32*b*. The bolt 38 passing through the antenna base is then screwed by a nut 42 via a wave washer 39, a washer 40, and a spring washer 41 to complete the pivottable connection configuration.

With the structure as mentioned above, when the convex portions 331 and 331 formed on the inner surface of the bottom face of the joint assembly 33 are engaged with one of the pairs of the holes 341 and 341, . . . formed on the bottom plate 34*a* inlaid in the outer face of the bottom face of the click cylinder 34, click torque is generated by the elasticity of the coil spring 35. In the same time, the terminal portion 33*a* of the joint assembly 33 shown in FIG. 7 is frictionally contacted with the terminal portion 322 of the supporting portion 32*b* which is pressed by the wave washer 39. The terminals are electrically connected thereby, and the antenna signal received by the antenna rod 31 is transmitted into the antenna base.

With the above-mentioned structure, the bottom plate of the joint assembly 33 realizes two functions of, i.e., generation of the click torque and the transmission of the antenna signal on both sides thereof. In addition, the bottom face of the joint assembly 33, which is intended to generate the click resistance. The bottom plate 34*a* of the click cylinder 34 can be both formed to have engaging shape by pressing or the like, and thus can be manufactured with low manufacturing cost. With the result, the manufacturing cost of the antenna can be reduced.

Further, a member with low elasticity can be employed as the wave washer 39, and thus the terminals can be electrically connected without so large click torque. Accordingly, the recess and convex portions for generating the click resistance can be prevented from being worn by large click torque, and thus the lifetime of the antenna can be lengthened even if the antenna rod is rotated so frequently.

In addition to the above, as shown in FIG. 5, there is no need to press the coil spring 35 in contrary to its own elasticity till the bolt 38 penetrates from the washer 37 to the spring washer 41 and the nut 42 screws the bolt 38 according to the structure of the present invention. Accordingly, the number of the assembling steps can be considerably reduced in comparing with the structure of the conventional pivottable connection configuration, and thus the assembling efficiency can be remarkably improved.

The present invention is not limited to the above-mentioned embodiment and it will be obvious to those of ordinary skill in the art various modifications can be attained within a scope from where the spirit of the invention as defined can be maintained free from any deviation.

Further, the above-mentioned embodiment includes various steps of inventions, and thus various inventions can be extracted by suitably combining a plurality of disclosed element. For example, even if some number of the elements are deleted from the all elements disclosed in the embodiment, the structure without the deleted elements can be extracted if at least one of the problems described in the description of the object of the invention can be solved and at least one of the effects can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A pivottable connection configuration of a retractable roof mounted antenna having an antenna rod and an antenna base for rotatably supporting the antenna rod, comprising:

a joint portion provided to one end portion of the antenna rod, said joint portion having a cylindrical member with a bottom and a rotation axis orthogonal to an axis of the antenna rod, said cylindrical member having a first and second surfaces perpendicular to the rotation axis, the first surface having one of recess and convex portions for generating click resistance, the second surface having a terminal surface electrically connected to the antenna rod;

a pair of supporting portions comprising a first and second supporting portions formed in an upper portion of the antenna base so as to surface each other, the first supporting portion having a through hole, the second supporting portion having a terminal portion electrically connected to the terminal surface of the joint portion on an inner surface facing to the through hole; and a click cylinder having one of convex and recess portions to be engaged with said one of the recess and convex portions of the first surface of the cylindrical member.

2. The pivottable connection configuration of the retractable roof mounted antenna according to claim 1, further comprising:

a wave washer contacting an outer surface of the second supporting portion;

a bolt passing through the members and the portions comprising the pivottable connection configuration; and a nut for screwing the bolt.

3. The pivottable connection configuration of the retractable roof mounted antenna according to claim 1, further comprising:

a coil spring to be introduced into the click cylinder; and a washer introduced into the through hole, wherein the washer is engaged with the first supporting portion such that rotation on a supporting axis of the first and second supporting portions is controlled.

4. The pivottable connection configuration of the retractable roof mounted antenna according to claim 3, further comprising:

a wave washer contacting an outer surface of the second supporting portion;

a bolt passing through the members and the portions comprising the pivottable connection configuration; and a nut for screwing the bolt.

* * * * *